US008245759B2

(12) United States Patent
Goettsch

(10) Patent No.: US 8,245,759 B2
(45) Date of Patent: Aug. 21, 2012

(54) LADLE FOR MOLTEN METAL

(75) Inventor: David D Goettsch, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 754 days.

(21) Appl. No.: 12/134,270

(22) Filed: Jun. 6, 2008

(65) Prior Publication Data

US 2009/0301681 A1 Dec. 10, 2009

(51) Int. Cl.
*B22D 35/04* (2006.01)
*B22D 41/04* (2006.01)

(52) U.S. Cl. ..... 164/136; 164/336

(58) Field of Classification Search ..... 164/136, 164/335, 336
See application file for complete search history.

(56) References Cited

U.S. PATENT DOCUMENTS

| | | | | |
|---|---|---|---|---|
| 1,414,566 | A * | 5/1922 | Gardner et al. | 164/376 |
| 4,130,158 | A * | 12/1978 | Kulig et al. | 164/289 |
| 4,510,987 | A * | 4/1985 | Collot | 164/71.1 |
| 6,386,265 | B1 * | 5/2002 | Usui | 164/114 |
| 6,488,886 | B1 | 12/2002 | Davis | |
| 6,715,535 | B2 * | 4/2004 | Kahn et al. | 164/136 |
| 7,025,115 | B2 | 4/2006 | Doty | |
| 7,074,361 | B2 | 7/2006 | Carolla et al. | |

FOREIGN PATENT DOCUMENTS

| | | |
|---|---|---|
| DE | 2635182 | 7/1977 |
| DE | 2651842 | 5/1978 |
| DE | 2921192 | 12/1980 |
| DE | 19959960 | 6/2000 |
| DE | 102005015862 | 10/2006 |
| GB | 633946 | 12/1949 |
| GB | 842158 | 7/1960 |

* cited by examiner

*Primary Examiner* — Kevin P Kerns
(74) *Attorney, Agent, or Firm* — Fraser Clemens Martin & Miller LLC; J. Douglas Miller

(57) ABSTRACT

An apparatus and method for quiescently filling of a ladle with molten material and transferring of the molten material from the ladle is disclosed, wherein the molten material is transferred from the ladle to a casting mold to minimize turbulence in the molten material to minimize defects in a desired cast object.

3 Claims, 3 Drawing Sheets

LADLE FOR MOLTEN METAL

FIELD OF THE INVENTION

This invention relates to an apparatus and method for the quiescent-fill of a ladle and the transfer of a molten material from the ladle to a casting mold to minimize turbulence in the molten material to minimize defects in a desired cast object formed by a tilt pour molding process.

BACKGROUND OF THE INVENTION

The pouring of a molten material, such as metal, for example, into a casting mold is a significant process variable that influences the internal soundness, surface conditions, and mechanical properties, such as tensile strength, porosity, percent elongation and hardness, of a cast object. Many different designs for dipping/pouring ladles exist and are used in the foundry industry. The designs are normally chosen based upon the type of molten material and casting mold used. Commonly used ladles make use of a slot, a lip and a baffle, or a dam at the top of the ladle to reduce inclusion of furnace metal oxides during metal filling, or the ladle may incorporate a stopper rod to control the flow of metal into and out of the ladle.

Molten metals, such as aluminum, for example, react with the air and create oxides, commonly known as dross, which upon mixing with the rest of the molten metal creates inclusions and highly porous regions in the cast object during solidification of the metal. While many factors influence and account for undesirable properties in the cast object, two common sources of inclusions include formation of a dross layer on top of the molten metal, and the folding action of the molten metal caused by turbulent flow of the molten metal during pouring. Turbulent metal flow exposes the molten metal surface area to the air which creates the dross layer. Depending on the velocity of the molten metal, dictated by the pouring ladle and basin design and use, the molten metal may fold-over itself many times, thereby trapping oxygen and metal oxide layers therein and exposing additional surface area of the metal to the air.

Typical foundry ladles are referred to as teapot-type ladles. These ladles are substantially cylindrical in shape with an external spout extending outwardly from the top thereof. Certain teapot ladles have incorporated a wall or a baffle to separate the bowl or cavity area of the ladle from the spout. The wall or baffle may extend to the bottom of the ladle. When the molten metal is poured, the baffle restricts the flow of molten metal from the top of the ladle to facilitate the pouring of the metal that is near the bottom of the ladle. The metal at the bottom of the ladle is substantially free from dross and other foreign material that may be present, such as eroded refractory lining and ash created during a melting process of the metal. Although the baffle serves to minimize dross inclusion, the external spout design still increases the velocity of the material upon pouring, and may create turbulent flow. Next, the molten metal is typically transferred from the ladle to a casting mold through a pour basin. In traditional pour basin designs, molten material flows down the basin to a mold sprue. The flow of the molten metal through the sprue may also cause turbulence therein, thereby creating additional dross.

Low pressure, bottom pour furnaces have been known to produce castings with minimized dross, but the equipment is expensive, complex, and subject to high maintenance requirements. In addition, the bottom pour furnaces increase capital costs. Hot Isostatic Pressing (HIPping) of castings may also reduce porosity in aluminum castings, however HIPping is expensive and may cause dimensional changes to the casting that may not be uniform or replicable.

Thus, there remains a need for an economical method and apparatus that would prevent or minimize the inclusion of dross and contaminants leading to high porosity and/or low mechanical properties of cast materials.

It would be desirable to provide an apparatus and method for the quiescent-fill of a ladle and the transfer of a molten material from the ladle to a casting mold to minimize turbulence in the molten material to minimize defects in the desired cast object formed by a tilt pour molding process.

SUMMARY OF THE INVENTION

Concordant and congruous with the present invention, an apparatus and method for the quiescent-fill of a ladle and the transfer of a molten material from the ladle to a casting mold to minimize turbulence in the molten material to minimize defects in the desired cast object formed by a tilt pour molding process, have surprisingly been discovered.

In one embodiment, a casting apparatus comprises a ladle having a hollow interior adapted to receive a molten material therein, wherein said ladle is adapted to pivot about an eccentric axis; and a mold having a cavity formed therein adapted to receive the molten material, wherein said ladle abuts said mold, and said mold and said ladle are cooperatively rotated to pour the molten material from said ladle into the cavity of said mold.

In another embodiment, a casting apparatus comprises a ladle having a hollow interior adapted to receive a molten material therein, said ladle having an aperture formed therein, wherein said ladle is adapted to pivot about an eccentric axis; and a mold having a cavity formed therein adapted to receive the molten material, wherein said ladle abuts said mold, and said mold and said ladle are cooperatively rotated to pour the molten material from said ladle into the cavity of said mold.

In another embodiment, a method of transferring a molten material to a casting mold, the method comprises providing a ladle having a hollow interior adapted to receive a molten material therein, the ladle having an aperture formed therein, wherein the ladle is adapted to rotate about an eccentric axis; providing a mold having a cavity formed therein adapted to receive the molten material, wherein the ladle abuts the mold and the mold and the ladle are cooperatively rotated to pour the molten material from the ladle into the cavity of the mold; filling the ladle with the molten material; positioning the aperture of the ladle adjacent the cavity of the mold; and rotating the mold and ladle to facilitate the pouring of the molten material from the ladle into the cavity of the mold.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE EMBODIMENTS

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
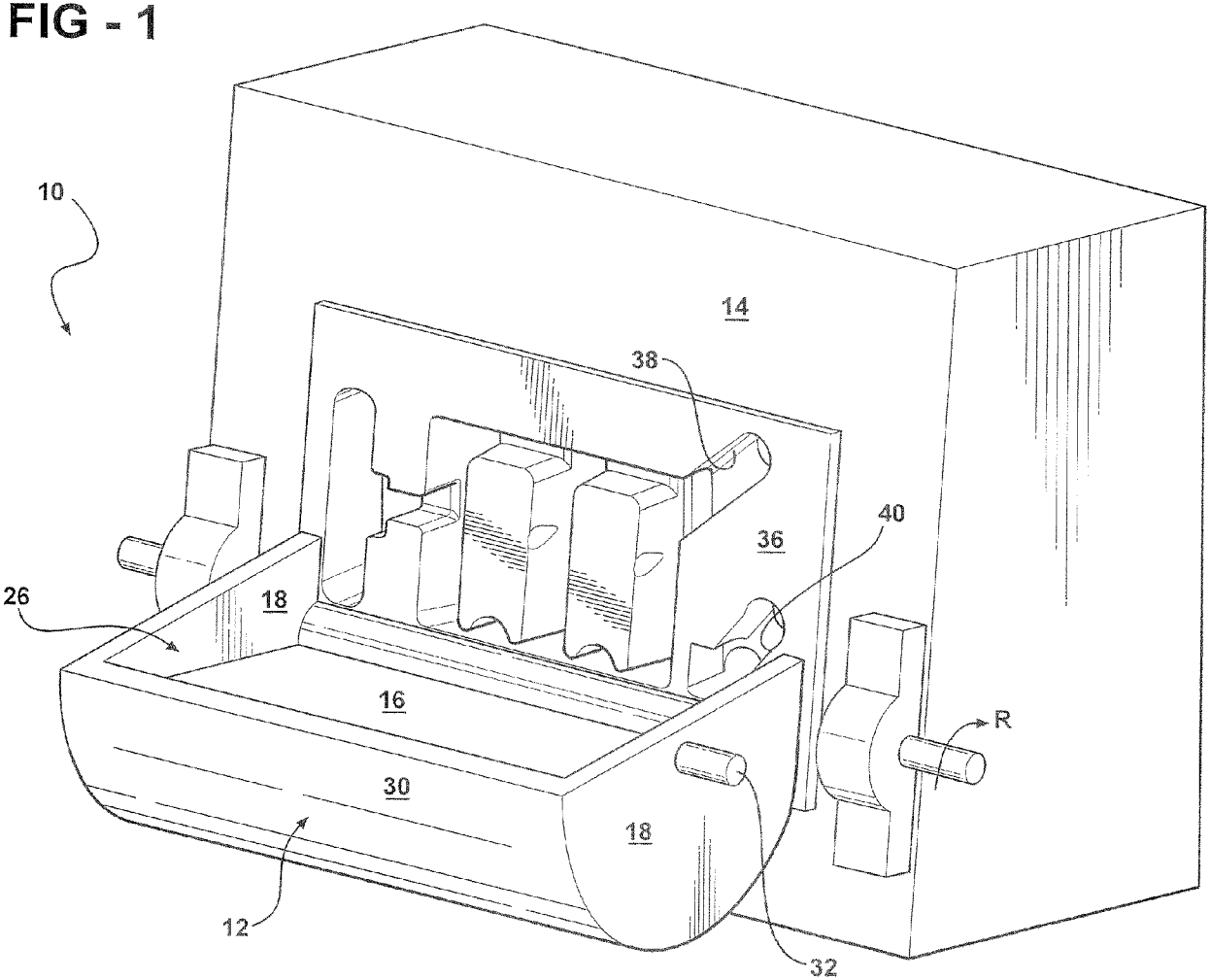
FIG. 1 is a perspective view of a molding apparatus including a ladle and a mold rotated ninety degrees according to an embodiment of the invention.

FIG. 1 shows a casting apparatus 10 according to an embodiment of the invention. The casting apparatus 10 includes ladle 12 adapted to receive a molten material 16 therein and to pour the molten material 16 therefrom. A mold 14 is provided in fluid communication with the ladle 12 and is adapted to receive the molten material 16 therefrom. It is understood that the molten material 16 may be any molten material such as a metal or a polymer, for example, as desired.

The ladle 12 is a quiescent-fill ladle similar to the ladle disclosed in commonly-owned U.S. Pat. No. 7,025,115, hereby incorporated herein by reference in its entirety. As used herein, the term "quiescent-fill" is defined as a ladle adapted to receive a molten material therein with a minimized amount of turbulence, agitation, and folding of the molten material. The ladle 12 may be formed from any conventional material such as a ceramic or a metal, for example, as desired. In the embodiment shown in FIGS. 1 and 2, the ladle 12 includes a hollow interior 26. The ladle 12 is formed by a pair of planar side walls 18, a substantially planar front wall 28, and a curvilinear wall 30. The side walls 18 are each defined by a curvilinear edge 20, a first rectilinear edge 22, and a second rectilinear edge 24. The second rectilinear edge 24 is adapted to abut the mold 14. Each side wall 18 includes a pin 32 formed thereon. In the embodiment shown, the pins 32 are adapted to facilitate a pivoting of the ladle 12 about an eccentric axis of rotation of the ladle 12 such that the front wall 28 pivots downwardly when the ladle 12 is filled with a molten material. It is understood that the pins 32 may be formed with the side walls 18, or the pins 32 may be separately formed and attached to the side walls 18.

The front wall 28 of the ladle 12 is adapted to substantially abut the mold 14. A second aperture 34 is formed in the front wall 28 of the ladle 12. In the embodiment shown, the second aperture 34 has a length substantially equal to a length of the front wall 28. However, the second aperture 34 may have any length, as desired. A top of the front wall 28 of the ladle 12 may include a protuberant portion or lip. The protuberant portion may be formed on an exterior of the front wall 28 or the interior of front wall 28 of the ladle 12, as desired. The curvilinear wall 30 forms a bottom wall and a back wall of the ladle 12. However, the bottom wall and back wall of the ladle 12 may be formed from a combination of a substantially planar wall and a curvilinear wall, a pair of substantially planar walls, or a pair of curvilinear walls, as desired.

In the embodiment shown in FIG. 1, the mold 14 is adapted to receive a molten material therein through a tilt-pour process. The mold 14 includes a body portion 36 forming a cavity 38 therein. A length of the cavity 38 is substantially equal to the length of the second aperture 34 formed in the front wall 28 of the ladle 12. The cavity 38 of the mold 14 may have the shape of any desired cast object, such as an engine block, a cylinder head, a complex transmission component, and the like, for example. The mold 14 also includes risers 40 adapted to form reservoirs that militate against the formation of cavities or voids in the desired cast object due to shrinkage of the molten material 16 during a cooling and solidification thereof.

In use, the ladle 12 is filled with the molten material 16 during a filling operation which includes: (1) positioning the ladle 12 in a rest position over a furnace dip well or crucible (not shown) filled with the molten material 16; (2) lowering the ladle 12 to the surface of the molten material 16 and making initial contact between the ladle 12 and the molten material 16; (3) rotating the ladle 12 about the eccentric axis on the pins 32 and exposing a portion of the aperture 34 to the molten material 16, thereby minimizing the drop of the molten material 16 into the ladle 12 during filling; (4) lowering the ladle 12 to a desired depth into the crucible; (5) rotating the ladle 12 back to the rest position; and (6) raising the ladle 12 containing molten material 16 from the crucible. By minimizing the drop of the molten material 16 into the ladle 12, turbulent flow of the molten material 16 into the ladle 12 and the folding of the molten material 16 therein is minimized.

As shown in FIG. 1, the mold 14 is rotated ninety degrees in respect of a floor or a surface parallel to the floor with a top of the cavity 38 thereof substantially perpendicular to the front wall 28 of the ladle 12. The second aperture 34 of the ladle 12 is positioned adjacent the cavity 38, with the front wall 28 of the ladle 12 abutting the mold 14. It is understood that the ladle 12 may be positioned adjacent to the cavity 38 with a small gap between the front wall 28 and the mold 14. The ladle 12 and the adjacent mold 14 are then rotated or otherwise controlled in unison, either secured together with attaching means (not shown) or by synchronized control of the ladle 12 and mold 14 together. The casting apparatus 10, which includes the ladle 12 and mold 14, is then caused to rotate ninety degrees as indicated by the arrow R about the eccentric axis on the pins 32 which may be located at a junction of the ladle 12 and the mold 14 or at the base of the mold 14, as desired. The rate of rotation of the casting apparatus 10 is regulated to facilitate a gravity-assisted, low velocity pour of the molten material 16 into the cavity 38 of the mold 14. Since the molten material 16 is poured directly into the cavity 38 and not into a gate system, the drop of the molten material 16 from the ladle 12 and into the cavity 38 is minimized. Since turbulence and folding of the molten material 16 are minimized, entrapment of air in the molten material 16 and oxidation of the molten material 16 are minimized, thereby minimizing deformities and defects and maximizing the quality of the cast object.

Once the molten material 16 has been allowed to cool and harden, the three-dimensional cast object may be removed from the mold 14. The cast object may then be further machined to result in a final shape thereof. Additional heat treating operations, coating processes, and the like can also be conducted on the casting.

Figure 2:
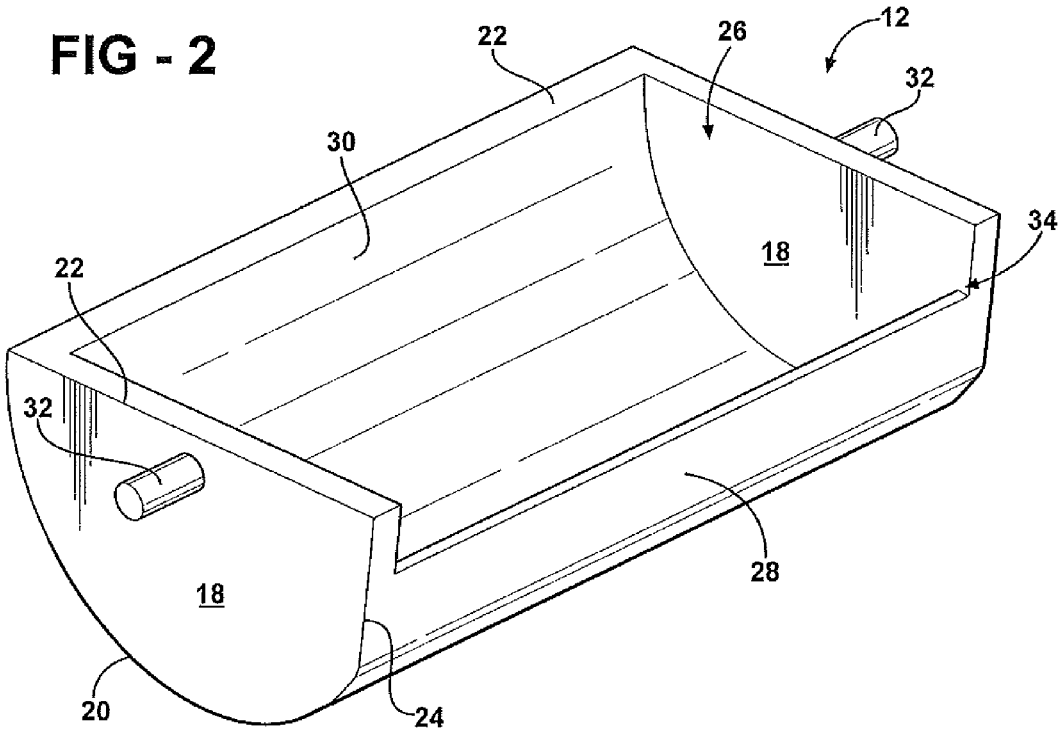
FIG. 2 is a perspective view of the ladle of FIG. 1.
Figure 3:
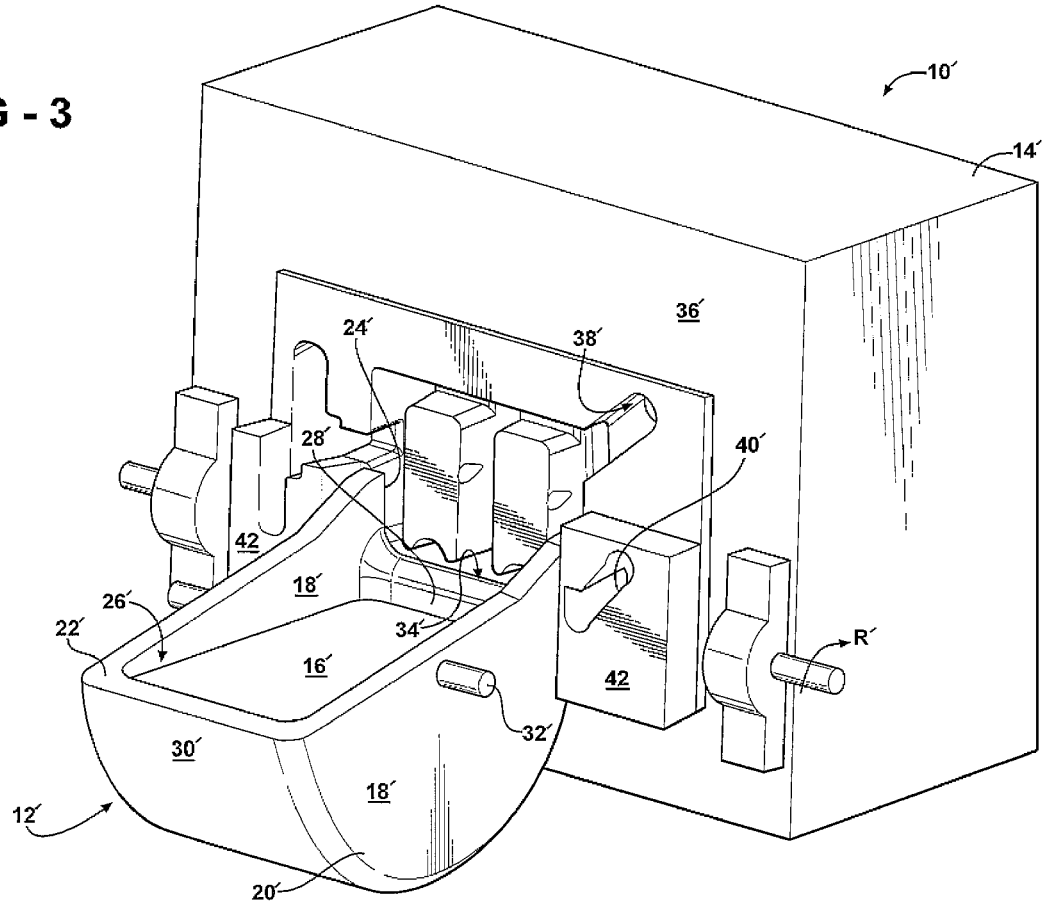
FIG. 3 is a perspective view of a molding apparatus including a ladle and a mold rotated ninety degrees according to another embodiment of the invention.

FIG. 3 shows a casting apparatus 10' according to another embodiment of the invention similar to the molding apparatus 10 of FIGS. 1 and 2 except as described below. This embodiment of FIG. 3 facilitates a ladle 12 width that does not cover the entire width of the cavity 38 of the mold 14. Having a ladle 12 with a width less than the width of the cavity 38 is desired when the cavity 38 of the mold 14 is so wide that a ladle having a matching width would be cumbersome to handle and difficult to fill with a dipping well or crucible. This embodiment allows for a reduced ladle width without the risk of spilling metal out of the open mold areas. Like structure from FIGS. 1 and 2 repeated in FIG. 3 includes identical reference numerals accompanied by a prime (') symbol.

The casting apparatus 10' includes a ladle 12' adapted to receive and pour a molten material 16'. A mold 14' is adapted to receive the molten material 16' from the ladle 12'. It is understood that the molten material 16' may be any molten material such as a metal or a polymer, for example, as desired.

The ladle 12' may be formed from any conventional material such as a ceramic or a metal, for example, as desired. In the embodiment shown, the ladle 12' includes a hollow interior 26' formed by a pair of planar side walls 18', a substantially planar front wall 28', and a curvilinear wall 30'. The side walls 18' are each defined by a curvilinear edge 20', a first rectilinear edge 22', and a second rectilinear edge 24'. The second rectilinear edge 24' is adapted to abut the mold 14'. Each side wall 18' includes a pin 32' formed thereon. In the embodiment shown, the pins 32' are adapted to facilitate the rotation of the ladle 12' on the pins 32' about an eccentric axis of rotation of the ladle 12'. It is understood that the pins 32' may be formed with the side walls 18', or the pins 32' may be separately formed and attached to the side walls 18'. However, the bottom wall and back wall of the ladle 12' may be formed from a combination of a rectilinear wall and a curvilinear wall, a pair of rectilinear walls, or a pair of curvilinear walls, as desired.

The front wall 28' of the ladle 12' is adapted to substantially abut the mold 14'. A second aperture 34' is formed in the front wall 28' of the ladle 12'. In the embodiment shown, the second aperture 34' has a length substantially equal to a length of the front wall 28', but the second aperture 34' may have any length, as desired. A top of the front wall 28' of the ladle 12' may include a protuberant portion or lip. The protuberant portion may be formed on an exterior of the front wall 28' or the interior of front wall 28' of the ladle 12', as desired. The curvilinear wall 30' defines a bottom wall and a back wall of the ladle 12'.

In the embodiment shown in FIG. 3, the mold 14' is adapted to receive a molten material therein through a tilt-pour process. The mold 14' includes a body portion 36' forming a cavity 38' therein and a pair of mold features 42 adapted to militate against a spilling of the molten material 16' from the mold cavity 38' during the tilt-pour process. A length of the cavity 38' is longer than the length of the second aperture 34' formed in the front wall 28' of the ladle 12'. The cavity 38' of the mold 14' may have the shape of any desired cast object, such as an engine block, a cylinder head, a complex transmission component, and the like, for example. The mold features 42 are disposed adjacent to the side walls 18' of the ladle 12' when the ladle 12' is disposed adjacent to the mold 14'. The mold features 42 have a height greater than the height of the portion of the mold cavity 38' disposed adjacent to the ladle 12'. The dimensions of the mold features 42 will vary based on the design of the ladle 12' and the rate at which the ladle 12' and the mold 14' are rotated during the tilt-pour process. As the rate of rotation increases, the rate of pouring of the molten material 16' increases, thereby increasing the height of the molten material 16' in the mold cavity 38' to a height above the aperture 34' of the ladle 12'. As the height of the molten material 16' in the mold cavity 38' increases, the dimensions of the mold features 42 increase to militate against spilling. The mold 14' also includes risers 40' adapted to form reservoirs that militate against the formation of cavities or voids in the desired cast object due to shrinkage of the molten material 16' during a cooling and solidification thereof.

In use, the ladle 12' is filled with the molten material 16' during a filling operation which includes: (1) positioning the ladle 12' in a rest position over a furnace dip well or crucible (not shown) filled with the molten material 16'; (2) lowering the ladle 12' to the surface of the molten material 16' and making initial contact between the ladle 12' and the molten material 16'; (3) rotating the ladle 12' about the eccentric axis on the pins 32' and exposing a portion of the aperture 34' to the molten material 16', thereby minimizing the drop of the molten material 16' into the ladle 12' during filling; (4) lowering the ladle 12' to a desired depth into the crucible; (5) rotating the ladle 12' back to the rest position; and (6) raising the ladle 12' containing molten material 16' from the crucible. By minimizing the drop of the molten material 16' into the ladle 12', turbulent flow of the molten material 16' into the ladle 12' and the folding of the molten material 16' therein is minimized.

As shown in FIG. 3, the mold 14' is rotated ninety degrees in respect of the floor or a surface parallel to the floor with a top of the cavity 38' substantially perpendicular to the ladle 12'. The second aperture 34' of the ladle 12' is positioned adjacent the cavity 38', with the front wall 28' of the ladle 12' abutting the mold 14'. It is understood that the ladle 12' may be positioned adjacent to the cavity 38' with a small gap between the front wall 28' and the mold 14'. The ladle 12' and the adjacent mold 14' are then rotated or otherwise controlled in unison, either secured together with attaching means (not shown) or by synchronized control of the ladle 12' and mold 14' together. The casting apparatus 10', which includes the ladle 12' and mold 14', is then caused to rotate ninety degrees as indicated by the arrow R' about the eccentric axis on the pins 32' which may be located at a junction of the ladle 12' and the mold 14' or at the base of the mold 14', as desired. The rate of rotation of the casting apparatus 10' is regulated to facilitate a gravity-assisted, low velocity pour of the molten material 16' into the cavity 38' of the mold 14'. As the molten material 16' enters the cavity 38', the molten material 16' flows therethrough filling void space in the cavity 38' until filled to a desired level. Since the molten material 16' is poured directly into the cavity 38' and not into a gate system, the drop of the molten material 16' from the ladle 12' and into the cavity 38' is minimized, thereby minimizing the turbulent flow and the folding thereof. Since turbulence and folding of the molten material 16' are minimized, entrapment of air in the molten material 16' and oxidation of the molten material 16' are minimized, thereby minimizing the deformities and maximizing the quality of the cast object.

Once the molten material 16' has been allowed to cool and harden, the three-dimensional cast object may be removed from the mold 14'. The cast object may then be further machined to result in a final shape thereof. Additional heat treating operations, coating processes, and the like can also be conducted on the casting.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A method of transferring a molten material to a casting mold, the method comprising:

providing a ladle having a hollow interior adapted to receive a molten material therein, the ladle having an aperture formed therein, wherein the ladle is adapted to rotate about an eccentric axis when filled with the molten material and wherein the pivoting about the eccentric axis minimizes a drop of the molten material into said ladle during a filling thereof with the molten material;

providing a mold having a cavity formed therein adapted to receive the molten material, wherein the ladle abuts the mold and the mold and the ladle are cooperatively rotated to pour the molten material from the ladle into the cavity of the mold, wherein the mold is without a gate system;

filling the ladle with the molten material;

positioning the aperture of the ladle adjacent the cavity of the mold; and rotating the mold and ladle to facilitate the pouring of the molten material from the ladle into the cavity of the mold.

2. A casting apparatus comprising:

a ladle having a hollow interior adapted to receive a molten material therein, wherein said ladle is adapted to pivot about an eccentric axis when filled with the molten material and wherein the pivoting about the eccentric axis minimizes a drop of the molten material into said ladle during a filling thereof with the molten material; and a mold having a cavity formed therein adapted to receive the molten material, wherein said ladle abuts said mold, and said mold and said ladle are cooperatively rotated to pour the molten material from said ladle into the cavity of said mold, wherein said mold is without a gate system.

3. A casting apparatus comprising:

a ladle having a hollow interior adapted to receive a molten material therein, wherein said ladle is adapted to pivot about an eccentric axis when filled with the molten material and wherein the pivoting about the eccentric axis minimizes a drop of the molten material into said ladle during a filling thereof with the molten material;

a mold having a cavity formed therein adapted to receive the molten material, wherein said ladle abuts said mold, and said mold and said ladle are cooperatively rotated to pour the molten material from said ladle into the cavity of said mold; and a mold feature having a height greater than a height of a portion of the cavity of said mold disposed adjacent said ladle.

* * * * *